US010080447B2

(12) United States Patent
Holst et al.

(10) Patent No.: US 10,080,447 B2
(45) Date of Patent: Sep. 25, 2018

(54) WATT TRIMMING CONTROLLER FOR A HEATED GLASS TEMPERATURE-CONTROLLED STORAGE DEVICE

(71) Applicant: Anthony, Inc., Sylmar, CA (US)

(72) Inventors: Kathleen Bridget Holst, Sylmar, CA (US); Paul J. Artwohl, Stevensville, MI (US)

(73) Assignee: Anthony, Inc., Sylmar, CA (US)

( * ) Notice: Subject to any disclaimer, the term of this patent is extended or adjusted under 35 U.S.C. 154(b) by 357 days.

(21) Appl. No.: 14/737,203

(22) Filed: Jun. 11, 2015

(65) Prior Publication Data

US 2016/0360900 A1 Dec. 15, 2016

(51) Int. Cl.
*A47F 3/04* (2006.01)
*H05B 1/02* (2006.01)
(Continued)

(52) U.S. Cl.
CPC ..... *A47F 3/0478* (2013.01); *A47F 3/0434* (2013.01); *F25D 21/04* (2013.01); *H05B 1/023* (2013.01); *H05B 3/84* (2013.01)

(58) Field of Classification Search
CPC ..... A47F 3/0434; A47F 3/0478; F25D 21/04; H05B 1/023; H05B 3/84
USPC ..... 219/203, 549, 421, 481, 522, 535, 553; 312/116, 128; 340/4.34; 427/108; 439/86; 700/295; 713/323
See application file for complete search history.

(56) References Cited

U.S. PATENT DOCUMENTS 4,260,876 A 4/1981 Hochheiser
5,406,049 A * 4/1995 Reiser ..... H05B 3/845 219/219
(Continued)

FOREIGN PATENT DOCUMENTS

EP 0565263 A1 10/1993
GB 2293253 A 3/1996
(Continued)

OTHER PUBLICATIONS

Communication under Rule 71(3) EPC for corresponding European Application No. 16163722.8, mail date Mar. 2, 2017, 7 pps.
(Continued)

*Primary Examiner* — Tu B Hoang
*Assistant Examiner* — Vy Nguyen
(74) *Attorney, Agent, or Firm* — Foley & Lardner LLP

(57) ABSTRACT

A controller for trimming power used by a heated glass temperature-controlled storage device comprising a frame and a door, the door comprising a door rail and a glass pane, wherein the glass pane includes a glass heater circuit, the controller comprising a variable impedance; a first impedance; a low pass filter; a diode for alternating current (DIAC); and a triode for alternating current (TRIAC), wherein the controller is configured to adjust voltage from the AC power input to a first voltage; filter the first voltage; generate a gate current when the DIAC is on; generate a glass current when the TRIAC is on; and provide the glass current to the glass heater circuit when the TRIAC is on, wherein the variable impedance is adjusted so power used by the glass heater circuit is below a first predetermined value.

20 Claims, 4 Drawing Sheets

(51) Int. Cl.
*H05B 3/84* (2006.01)
*F25D 21/04* (2006.01)

(56) References Cited

U.S. PATENT DOCUMENTS 5,624,591 A * 4/1997 Di Trapani ..... B32B 17/10036 219/203
5,959,816 A * 9/1999 Wood ..... A47F 3/0434 361/104
6,144,017 A * 11/2000 Millett ..... F25D 21/02 219/203
8,461,495 B2 * 6/2013 Gerhardinger ..... A47F 3/0434 219/522

FOREIGN PATENT DOCUMENTS

GB 2408158 A 5/2005
WO WO 00/76274 A1 12/2000

OTHER PUBLICATIONS

Extended European Search Report regarding corresponding European Application No. 16163722.8, dated Oct. 20, 2016, 6 pages.

* cited by examiner

WATT TRIMMING CONTROLLER FOR A HEATED GLASS TEMPERATURE-CONTROLLED STORAGE DEVICE

BACKGROUND

The present disclosure relates generally to heated glass temperature-controlled storage device and more particularly to a controller, system, and method for trimming power used by a heated glass temperature-controlled storage device.

Heated glass temperature-controlled storage devices (e.g., refrigerators, freezers, refrigerated merchandisers, etc.) are used in a wide variety of commercial, institutional, and residential applications for storing and/or displaying refrigerated or frozen items. For example, self-service type refrigerated display cases or merchandisers are often used in grocery stores, supermarkets, convenience stores, florist shops, and other commercial settings to store and display the temperature-sensitive consumer goods (e.g., food products and the like).

Many heated glass temperature-controlled storage device have a glass door through which items within the heated glass temperature-controlled storage device may be viewed. A heated glass temperature-controlled storage device often includes heaters in the glass door and the door frame to prevent condensation from forming on and around the glass of the storage device.

Since glass is a conducting material, the glass doors of heated glass temperature-controlled storage devices are commonly coated with a resistive material to which is applied a current to heat the material and thereby the glass. The resistive material has a standard impedance, and the impedance of glass coated with the resistive material depends in part on the standard impedance, thickness of the coating, and size of the glass. When a current is applied, the power used is generated as heat, where the amount of heat generated depends on the applied current. A number of factors determine how much heat is necessary to prevent or eliminate condensation, including the ambient environment and size of the glass. For instance, a heated glass temperature-controlled storage device used in a humid environment would require more heat than would a heated glass temperature-controlled storage device used in an arid environment. Therefore, the glass of a heated glass temperature-controlled storage device for a humid area optimally should be coated with less material than one for an arid area. Coating of resistive material often is done in certain standard amounts, without allowing for particular resistive values. This leads to situations where the amount of power used by a heated glass temperature-controlled storage device is greater than a minimum amount necessary to prevent condensation. This gives rise to a need for a means for applying a proper current to a glass heater circuit which may have a predetermined resistive value, and may be used in environments with varying humidity and temperature. There is a need for a reliable, low-cost, and predictable method of applying current to the resistive material on such heated glass temperature-controlled storage device to limit the power used to be within a predetermined value.

SUMMARY

Embodiments described herein relate to a controller for trimming power used by a heated glass temperature-controlled storage device comprising a frame and a door, the door comprising a door rail and a glass pane, wherein the glass pane includes a glass heater circuit, the controller comprising a variable impedance; a first impedance; a low pass filter; a diode for alternating current (DIAC); and a triode for alternating current (TRIAC), wherein the variable impedance is coupled in parallel to the first impedance; the variable impedance is coupled at a first terminal to an AC power input; the variable impedance is coupled at a second terminal to an input of the low pass filter; the DIAC is coupled at a first DIAC terminal to an output of the low pass filter; the DIAC is coupled at a second DIAC terminal to a gate of the TRIAC; the TRIAC is coupled at a first TRIAC terminal to the AC power input; and the TRIAC is coupled at a second TRIAC terminal to the glass heater circuit, wherein the controller is configured to adjust, via the variable impedance and first impedance, voltage from the AC power input to a first voltage; filter, via the low pass filter, the first voltage; generate, via the DIAC, a gate current when the DIAC is on, wherein the DIAC is on when the filtered first voltage applied to the first DIAC terminal causes the DIAC to conduct; generate, via the TRIAC, a glass current when the TRIAC is on, wherein the TRIAC is on when the gate current applied to the gate of the TRIAC causes the TRIAC to conduct, and wherein the glass current is a proportion of current of the AC power input; and provide the glass current to the glass heater circuit when the TRIAC is on, wherein the variable impedance is adjusted so power used by the glass heater circuit is below a first predetermined value.

In some embodiments, the variable impedance is a potentiometer.

In some embodiments, the variable impedance is a toggle switch.

In some embodiments, the low pass filter is a second-order passive low pass filter.

In some embodiments, comprising a heatsink coupled to the controller, wherein the heatsink is directed to transfer heat into the door rail of the storage device.

In some embodiments, comprising a heatsink coupled to the controller, wherein the heatsink is directed to transfer heat into the frame of the storage device.

Embodiments described herein relate to a system for trimming power used by a heated glass temperature-controlled storage device comprising a frame and a door, the door comprising a door rail and a glass pane, wherein the glass pane includes a glass heater circuit, the system comprising the storage device; and a controller comprising a first controller terminal and a second controller terminal, wherein the controller is coupled at the first controller terminal to an AC power input; the controller is coupled at the second controller terminal to a first end of the glass heater circuit; and the glass heater circuit is coupled at a second end to a power return line, and wherein the controller is configured to adjust, via a variable impedance coupled in parallel to a first impedance, voltage from the AC power input to a first voltage; filter, via a low pass filter, the first voltage; generate, via a DIAC, a gate current when the DIAC is on, wherein the DIAC is on when the filtered first voltage applied to the first DIAC terminal causes the DIAC to conduct; generate, via a TRIAC, a glass current when the TRIAC is on, wherein the TRIAC is on when the gate current applied to a gate of the TRIAC causes the TRIAC to conduct, and wherein the glass current is a proportion of current of the AC power input; and provide the glass current to the glass heater circuit when the TRIAC is on, wherein the variable impedance is adjusted so power used by the glass heater circuit is below a first predetermined value.

In some embodiments, the variable impedance is a potentiometer.

In some embodiments, the variable impedance is a toggle switch.

In some embodiments, the low pass filter is a second-order passive low pass filter.

In some embodiments, comprising a heatsink coupled to the controller, wherein the heatsink is directed to transfer heat into the door rail of the storage device.

In some embodiments, comprising a heatsink coupled to the controller, wherein the heatsink is directed to transfer heat into the frame of the storage device.

In some embodiments, the door of the storage device further comprises a door heater circuit; and the glass heater circuit is coupled to the power return line via the door heater circuit.

In some embodiments, the door of the storage device further comprises a door heater circuit; and the glass heater circuit is coupled, in parallel with the door heater circuit, to the power return line.

Embodiments described herein relate to a method for trimming power used by a heated glass temperature-controlled storage device, the method comprising adjusting, via a variable impedance coupled in parallel to a first impedance, voltage from an AC power input to a first voltage; filtering, via a low pass filter, the first voltage; generating, via a DIAC, a gate current when the DIAC is on, wherein the DIAC is on when the filtered first voltage applied to a first DIAC terminal causes the DIAC to conduct; generating, via the TRIAC, a glass current when the TRIAC is on, wherein the TRIAC is on when the gate current applied to a gate of the TRIAC causes the TRIAC to conduct, and wherein the glass current is a proportion of current of the AC power input; and providing the glass current to the glass heater circuit when the TRIAC is on, wherein the variable impedance is adjusted so power used by the glass heater circuit is below a first predetermined value.

In some embodiments, the variable impedance is a potentiometer.

In some embodiments, the variable impedance is a toggle switch.

In some embodiments, the low pass filter is a second-order low pass filter.

In some embodiments, directing, via a heatsink, heat into a door rail of the storage device.

In some embodiments, directing, via a heatsink, heat into a frame of the storage device.

The foregoing is a summary and thus by necessity contains simplifications, generalizations, and omissions of detail. Consequently, those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

BRIEF DESCRIPTION

DETAILED DESCRIPTION

Figure 1:
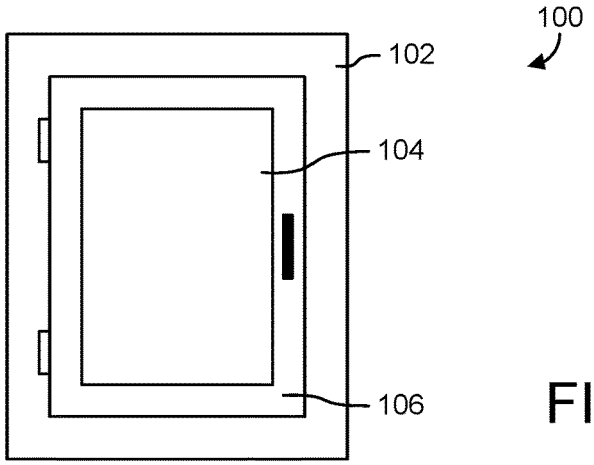
FIG. 1 is a diagram of a heated glass temperature controlled storage device, according to an exemplary embodiment.

Referring now to FIG. 1, a heated glass temperature-controlled storage device 100 is shown, according to an exemplary embodiment. In embodiments, heated glass temperature-controlled storage device 100 comprises a frame 102 and a door, wherein the door comprises a glass pane 104 and a door rail 106. In some embodiments, the door is a hinged door. In some embodiments, the door is a sliding door. In some embodiments, the heated glass temperature-controlled storage device 100 may comprise more than one door. In some embodiments, the door may comprise more than one glass pane 104.

Figure 2:
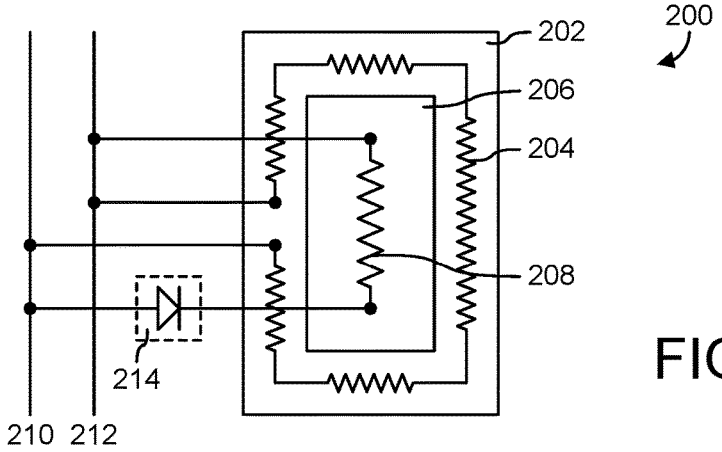
FIG. 2 is a circuit diagram of a door of a heated glass temperature-controlled storage device, according to an exemplary embodiment.

Referring now to FIG. 2, a circuit diagram of a door 200 of a heated glass temperature controlled storage device is shown, according to an exemplary embodiment. In embodiments, door 200 comprises a door rail 202 and a glass plane 206. In embodiments, glass pane 206 includes glass heater circuit 208. In some embodiments, glass heater circuit 208 is coupled to AC power input 210 and power return line 212. In some embodiments, door rail 202 may further comprise door heater circuit 204. In some embodiments, door heater circuit 204 is coupled to AC power input 210 and power return line 212. In some embodiments, door heater circuit 204 may keep door rail 202 at a temperature comfortable for a person to handle and open door 200.

Still referring to FIG. 2, glass heater circuit 208 may provide a predetermined resistive value greater than a minimum resistive value necessary to prevent, reduce, or eliminate condensation on glass pane 206. In some embodiments, a controller 214 may be coupled between AC power input 210 and glass heater circuit 208. In some embodiments, controller 214 may be a diode. In some embodiments, controller 214 limits when current flows to glass heater circuit 208, and thus limits power used by glass heater circuit 208. In some embodiments, glass heater circuit 208 is chosen such that the predetermined resistive value is essentially twice the minimum resistive value. In some embodiments, current allowed by controller 214 is chosen to limit the power used by glass heater circuit 208 to essentially half the value glass heater circuit would use without controller 214.

Figure 3:
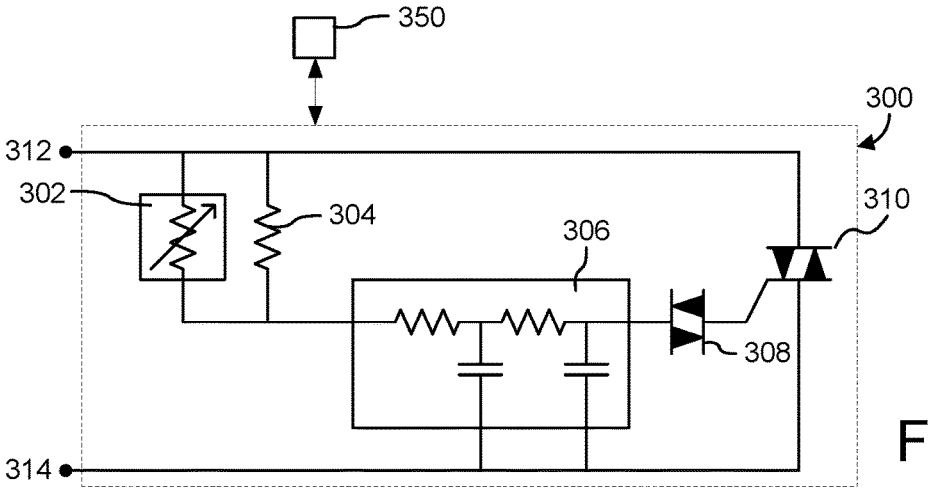
FIG. 3 is a circuit diagram of a controller of a heated glass temperature-controlled storage device, according to an exemplary embodiment.

Referring now to FIG. 3, a circuit diagram of a controller 300 of a heated glass temperature controlled storage device is shown, according to an exemplary embodiment. In embodiments, controller 300 is configured to trim power used by a heated glass temperature-controlled storage device comprising a frame and a door, the door comprising a door rail and a glass pane, wherein the glass pane includes a glass heater circuit. In embodiments, controller 300 comprises a variable impedance 302; a first impedance 304; a low pass filter 306; a diode for alternating current (DIAC) 308; and a triode for alternating current (TRIAC) 310. In embodiments, variable impedance 302 is coupled in parallel to first impedance 304. In embodiments, variable impedance 302 is coupled at a first terminal to an AC power input 312. In embodiments, variable impedance 302 is coupled at a second terminal to an input of the low pass filter 306. In embodiments, DIAC 308 is coupled at a first DIAC terminal to an output of the low pass filter 306. In embodiments, DIAC 308 is coupled at a second DIAC terminal to a gate of the TRIAC 310. In embodiments, TRIAC 310 is coupled at a first TRIAC terminal to AC power input 312. In embodiments, TRIAC 310 is coupled at a second TRIAC terminal to the glass heater circuit, wherein controller 300 is configured to adjust, via variable impedance 302 and first impedance 304, voltage from AC power input 312 to a first voltage. In embodiments, controller 300 is configured to filter, via low pass filter 306, the first voltage. In embodiments, controller 300 is configured to generate, via DIAC 308, a gate current when DIAC 308 is on, wherein DIAC 308 is on when the filtered first voltage applied to the first DIAC terminal causes DIAC 308 to conduct. In embodiments, controller 300 is configured to generate, via TRIAC 310, a glass current when TRIAC 310 is on, wherein TRIAC 310 is on when the gate current applied to the gate of TRIAC 310 causes TRIAC 310 to conduct, and wherein the glass current is a proportion of current of AC power input 312. In embodiments, controller 300 is configured to provide the glass current to the glass heater circuit when TRIAC 310 is on, wherein variable impedance 302 is adjusted so power used by the glass heater circuit is below a first predetermined value. In some embodiments, the first predetermined value may be determined on a basis of factors including door size, ambient environmental temperatures, and regulations limiting power use. In some embodiments, the first predetermined value may be 0.24 watts.

Still referring to FIG. 3, in some embodiments, variable impedance 302 is a potentiometer. In some embodiments, variable impedance 302 is a toggle switch. In some embodiments, low pass filter 306 is a second-order passive low pass filter. In some embodiments, a heatsink 350 is coupled to controller 300, wherein the heatsink 350 is directed to transfer heat into the door rail of the storage device. In some embodiments, a heatsink 350 is coupled to controller 300, wherein the heatsink 350 is directed to transfer heat into the frame of the storage device. In embodiments with a heatsink 350, the directed heat may reduce or eliminate the need for a door heater circuit or heater circuitry in the frame. This repurposes the heat generated by the controller 300, and thus allows for more efficient use of power. In some embodiments, controller 300 may be used in place of controller 214 in FIG. 2. As controller 300 allows for adjustments, the amount of power used by a heated glass temperature-controlled storage device may be more finely tuned than by using a diode as a controller. Additionally, when the purpose of the heated glass temperature-controlled storage device changes, or the environment in which the heated glass temperature-controlled storage device is used changes, the amount of power used by the glass heater circuit to prevent, reduce, or eliminate condensation may change, and the amount of current provided by controller 300 may be adjusted via variable impedance 302. In contrast, a diode controller would have to be replaced to change the amount of current provided to a glass heater circuit.

Figure 4A:
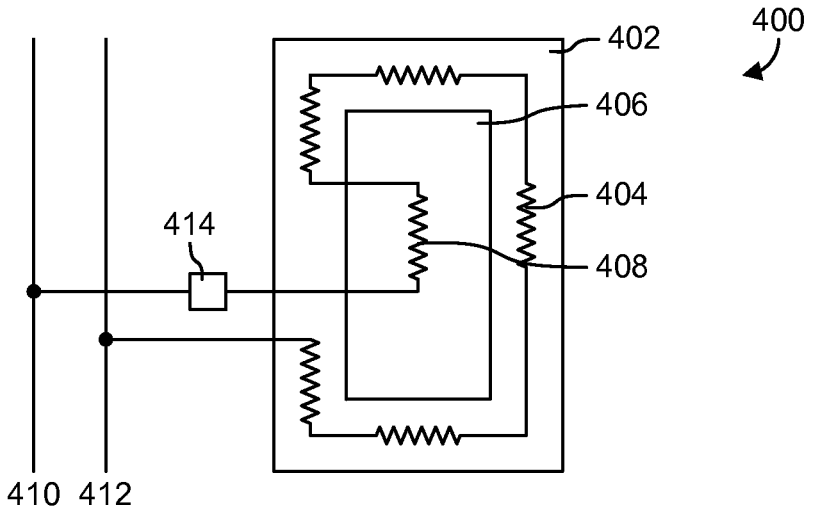
FIG. 4A is a circuit diagram of a system comprising a heated glass temperature-controlled storage device with a controller, according to an exemplary embodiment.

Referring now FIG. 4A, a circuit diagram of a system 400 comprising a heated glass temperature-controlled storage device with a controller 414 is shown, according to an exemplary embodiment. In embodiments, system 400 comprises a heated glass temperature-controlled storage device and a controller 414. In embodiments, the heated glass temperature-controlled storage device comprises a frame and a door. In embodiments, the door of the heated glass temperature-controlled storage device comprises door rail 402 and glass pane 406. In embodiments, glass pane 406 includes glass heater circuit 408. In embodiments, controller 414 comprises a first controller terminal and a second controller terminal. In embodiments, controller 414 is coupled at the first controller terminal to an AC power input 410. In embodiments, controller 414 is coupled at the second controller terminal to a first end of glass heater circuit 408. In embodiments, glass heater circuit 408 is coupled at a second end to a power return line 412. In embodiments, controller 414 is configured to adjust, via a variable impedance coupled in parallel to a first impedance, voltage from AC power input 410 to a first voltage. In embodiments, controller 414 is configured to filter, via a low pass filter, the first voltage. In embodiments, controller 414 is configured to generate, via a DIAC, a gate current when the DIAC is on, wherein the DIAC is on when the filtered first voltage applied to the first DIAC terminal causes the DIAC to conduct. In embodiments, controller 414 is configured to generate, via a TRIAC, a glass current when the TRIAC is on, wherein the TRIAC is on when the gate current applied to a gate of the TRIAC causes the TRIAC to conduct, and wherein the glass current is a proportion of current of AC power input 410. In embodiments, controller 414 is configured to provide the glass current to glass heater circuit 408 when the TRIAC is on, wherein the variable impedance is adjusted so power used by the glass heater circuit is below a first predetermined value.

Still referring to FIG. 4A, in some embodiments, the variable impedance is a potentiometer. In some embodiments, the variable impedance is a toggle switch. In some embodiments, the low pass filter is a second-order passive low pass filter. In some embodiments, controller 414 comprises a heatsink coupled to the controller, wherein the heatsink is directed to transfer heat into door rail 402 of the storage device. In some embodiments, controller 414 further comprises a heatsink coupled to the controller, wherein the heatsink is directed to transfer heat into the frame of the storage device. In some embodiments, the door of the storage device further comprises a door heater circuit 404; and glass heater circuit 408 is coupled to power return line 412 via door heater circuit 404.

Figure 4B:
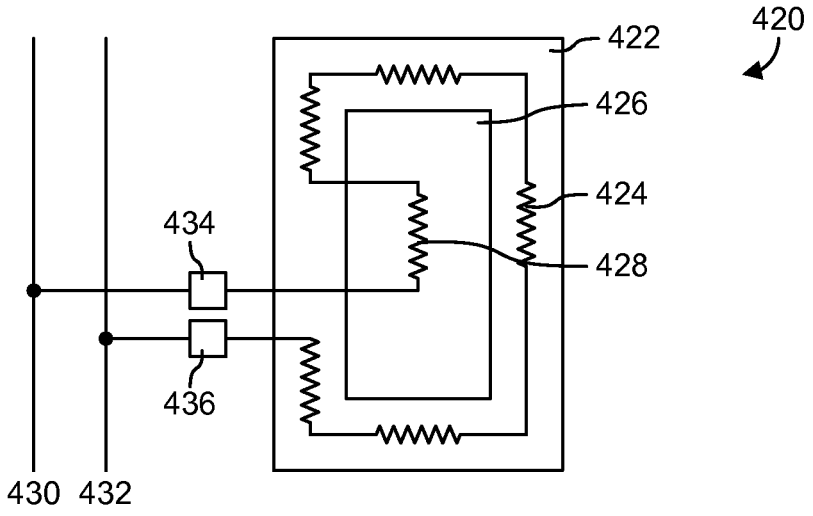
FIG. 4B is a circuit diagram of a system comprising a heated glass temperature-controlled storage device with a controller and a diode, according to an exemplary embodiment.

Referring now to FIG. 4B, a circuit diagram of a system 420 comprising a heated glass temperature controlled storage device with a controller 434 and a diode 436 is shown, according to an exemplary embodiment. In embodiments, system 420 comprises a heated glass temperature-controlled storage device and a controller 434. In embodiments, the heated glass temperature-controlled storage device comprises a frame and a door. In embodiments, the door of the heated glass temperature-controlled storage device comprises door rail 422 and glass pane 426. In embodiments, glass pane 426 includes glass heater circuit 428. In embodiments, controller 434 comprises a first controller terminal and a second controller terminal. In embodiments, controller 434 is coupled at the first controller terminal to an AC power input 430. In embodiments, controller 434 is coupled at the second controller terminal to a first end of glass heater circuit 428. In embodiments, glass heater circuit 428 is coupled at a second end to a power return line 432. In embodiments, controller 434 is configured to adjust, via a variable impedance coupled in parallel to a first impedance, voltage from AC power input 430 to a first voltage. In embodiments, controller 434 is configured to filter, via a low pass filter, the first voltage. In embodiments, controller 434 is configured to generate, via a DIAC, a gate current when the DIAC is on, wherein the DIAC is on when the filtered first voltage applied to the first DIAC terminal causes the DIAC to conduct. In embodiments, controller 434 is configured to generate, via a TRIAC, a glass current when the TRIAC is on, wherein the TRIAC is on when the gate current applied to a gate of the TRIAC causes the TRIAC to conduct, and wherein the glass current is a proportion of current of AC power input 430. In embodiments, controller 434 is configured to provide the glass current to glass heater circuit 428 when the TRIAC is on, wherein the variable impedance is adjusted so power used by the glass heater circuit is below a first predetermined value.

Still referring to FIG. 4B, in some embodiments, the variable impedance is a potentiometer. In some embodiments, the variable impedance is a toggle switch. In some embodiments, the low pass filter is a second-order passive low pass filter. In some embodiments, controller 434 comprises a heatsink coupled to the controller, wherein the heatsink is directed to transfer heat into door rail 422 of the storage device. In some embodiments, controller 434 further comprises a heatsink coupled to the controller, wherein the heatsink is directed to transfer heat into the frame of the storage device. In embodiments, the door of the storage device further comprises a door heater circuit 424; and glass heater circuit 428 is coupled to power return line 432 via door heater circuit 424 and diode 436.

Figure 4C:
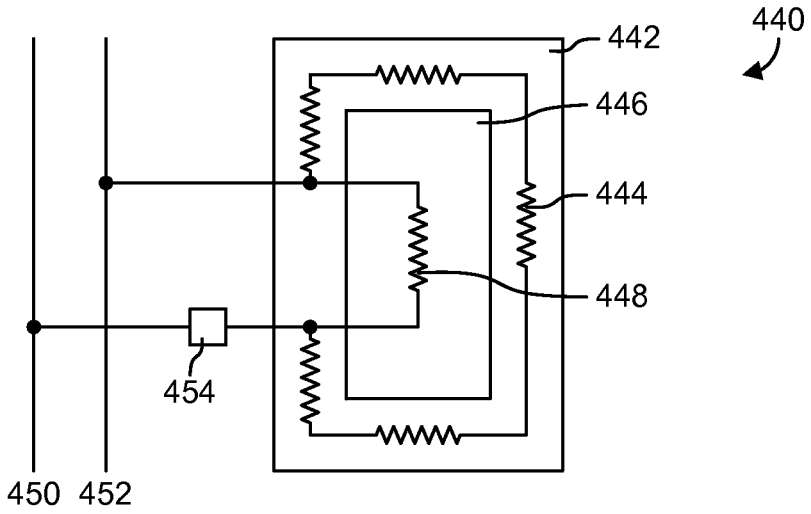
FIG. 4C is a circuit diagram of a system comprising a heated glass temperature-controlled storage device with a controller, according to another exemplary embodiment.

Referring now FIG. 4C, a circuit diagram of a system 440 comprising heated glass temperature controlled storage device with a controller 454 is shown, according to an exemplary embodiment. In embodiments, system 440 comprises a heated glass temperature-controlled storage device and a controller 454. In embodiments, the heated glass temperature-controlled storage device comprises a frame and a door. In embodiments, the door of the heated glass temperature-controlled storage device comprises door rail 442 and glass pane 446. In embodiments, glass pane 446 includes glass heater circuit 448. In embodiments, controller 444 comprises a first controller terminal and a second controller terminal. In embodiments, controller 454 is coupled at the first controller terminal to an AC power input 450. In embodiments, controller 454 is coupled at the second controller terminal to a first end of glass heater circuit 448. In embodiments, glass heater circuit 448 is coupled at a second end to a power return line 452. In embodiments, controller 454 is configured to adjust, via a variable impedance coupled in parallel to a first impedance, voltage from AC power input 450 to a first voltage. In embodiments, controller 454 is configured to filter, via a low pass filter, the first voltage. In embodiments, controller 454 is configured to generate, via a DIAC, a gate current when the DIAC is on, wherein the DIAC is on when the filtered first voltage applied to the first DIAC terminal causes the DIAC to conduct. In embodiments, controller 454 is configured to generate, via a TRIAC, a glass current when the TRIAC is on, wherein the TRIAC is on when the gate current applied to a gate of the TRIAC causes the TRIAC to conduct, and wherein the glass current is a proportion of current of AC power input 450. In embodiments, controller 454 is configured to provide the glass current to glass heater circuit 448 when the TRIAC is on, wherein the variable impedance is adjusted so power used by the glass heater circuit is below a first predetermined value.

Still referring to FIG. 4C, in some embodiments, the variable impedance is a potentiometer. In some embodiments, the variable impedance is a toggle switch. In some embodiments, the low pass filter is a second-order passive low pass filter. In some embodiments, controller 454 comprises a heatsink coupled to the controller, wherein the heatsink is directed to transfer heat into door rail 442 of the storage device. In some embodiments, controller 454 further comprises a heatsink coupled to the controller, wherein the heatsink is directed to transfer heat into the frame of the storage device. In some embodiments, the door of the storage device further comprises a door heater circuit 444; and glass heater circuit 448 is coupled, in parallel with door heater circuit 444, to power return line 452.

Figure 4D:
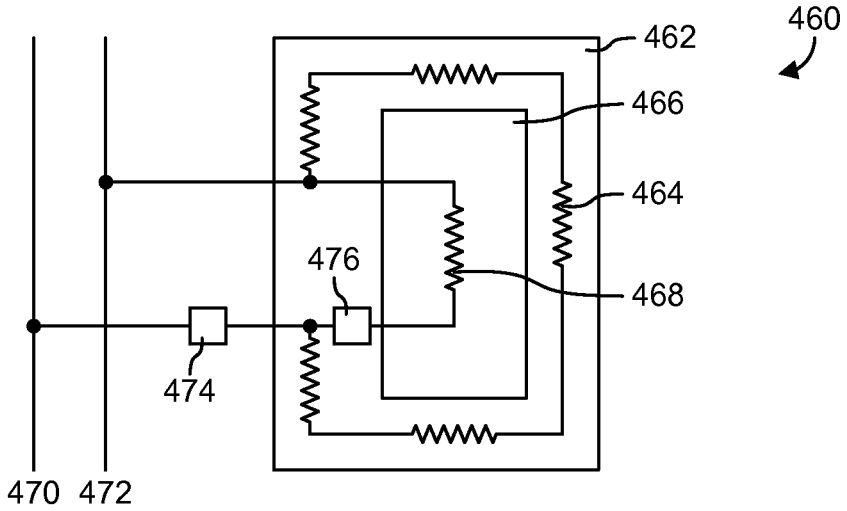
FIG. 4D is a circuit diagram of a system comprising a heated glass temperature-controlled storage device with a controller and a diode, according to another exemplary embodiment.

Referring now to FIG. 4D, a circuit diagram of a system 460 comprising a heated glass temperature controlled storage device with a controller 474 and a diode 476, according to an exemplary embodiment. In embodiments, system 460 comprises a heated glass temperature-controlled storage device and a controller 474. In embodiments, the heated glass temperature-controlled storage device comprises a frame and a door. In embodiments, the door of the heated glass temperature-controlled storage device comprises door rail 462 and glass pane 466. In embodiments, glass pane 466 includes glass heater circuit 468. In embodiments, controller 474 comprises a first controller terminal and a second controller terminal. In embodiments, controller 474 is coupled at the first controller terminal to an AC power input 470. In embodiments, controller 474 is coupled at the second controller terminal to a first diode terminal of diode 476. In embodiments, diode 476 is coupled at a second diode terminal to a first end of glass heater circuit 468. In embodiments, glass heater circuit 468 is coupled at a second end to a power return line 472. In embodiments, controller 474 is configured to adjust, via a variable impedance coupled in parallel to a first impedance, voltage from AC power input 470 to a first voltage. In embodiments, controller 474 is configured to filter, via a low pass filter, the first voltage. In embodiments, controller 474 is configured to generate, via a DIAC, a gate current when the DIAC is on, wherein the DIAC is on when the filtered first voltage applied to the first DIAC terminal causes the DIAC to conduct. In embodiments, controller 474 is configured to generate, via a TRIAC, a glass current when the TRIAC is on, wherein the TRIAC is on when the gate current applied to a gate of the TRIAC causes the TRIAC to conduct, and wherein the glass current is a proportion of current of AC power input 470. In embodiments, controller 474 is configured to provide the glass current to glass heater circuit 468 when the TRIAC is on, wherein the variable impedance is adjusted so power used by the glass heater circuit is below a first predetermined value.

Still referring to FIG. 4D, in some embodiments, the variable impedance is a potentiometer. In some embodiments, the variable impedance is a toggle switch. In some embodiments, the low pass filter is a second-order passive low pass filter. In some embodiments, controller 474 comprises a heatsink coupled to the controller, wherein the heatsink is directed to transfer heat into door rail 462 of the storage device. In some embodiments, controller 474 further comprises a heatsink coupled to the controller, wherein the heatsink is directed to transfer heat into the frame of the storage device. In some embodiments, the door of the storage device further comprises a door heater circuit 464; and glass heater circuit 468 is coupled, in parallel with door heater circuit 464, to power return line 472.

Figure 5:
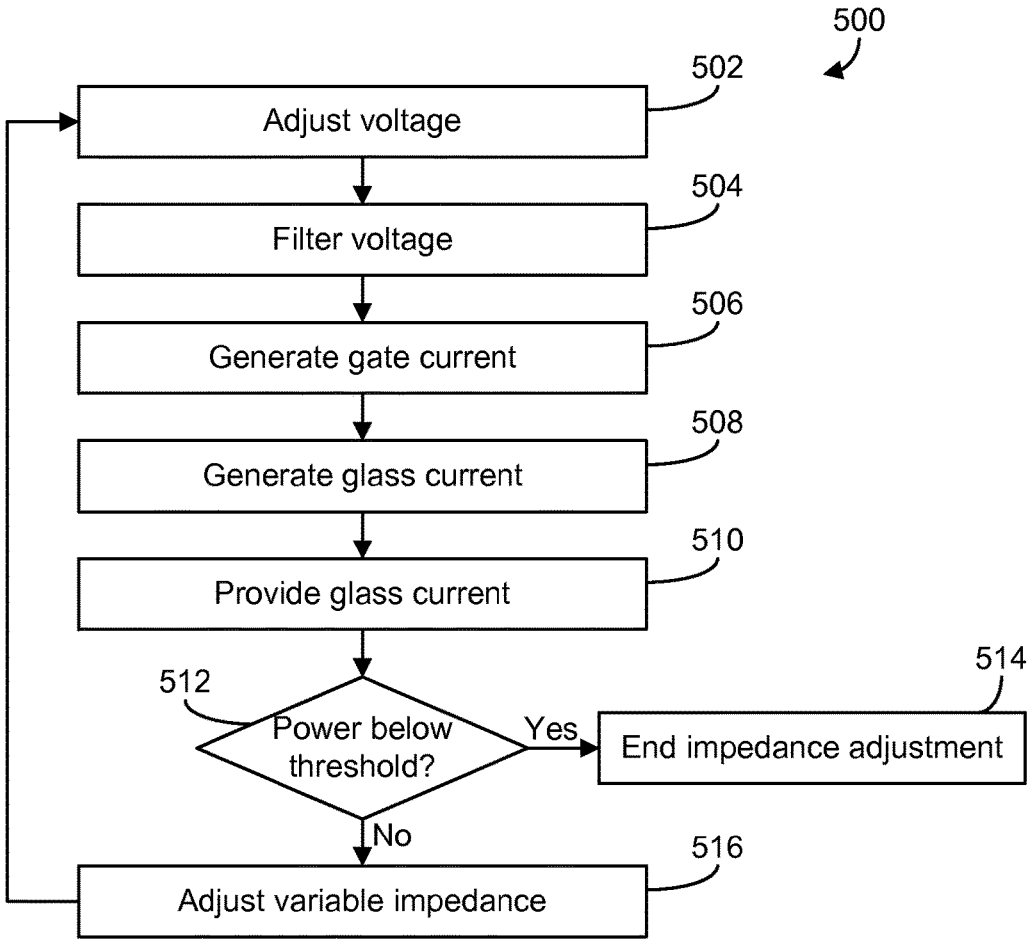
FIG. 5 is a flow chart of a process for controlling power used by a heated glass temperature-controlled storage device, according to an exemplary embodiment.

Referring now to FIG. 5, a flow chart of a process for controlling power used by a heated glass temperature-controlled storage device, according to an exemplary embodiment. In embodiments, the process comprises adjusting, via a variable impedance coupled in parallel to a first impedance, voltage from an AC power input to a first voltage (502); filtering, via a low pass filter, the first voltage (504); generating, via a DIAC, a gate current when the DIAC is on, wherein the DIAC is on when the filtered first voltage applied to a first DIAC terminal causes the DIAC to conduct (506); generating, via the TRIAC, a glass current when the TRIAC is on, wherein the TRIAC is on when the gate current applied to a gate of the TRIAC causes the TRIAC to conduct, and wherein the glass current is a proportion of current of the AC power input (508); and providing the glass current to the glass heater circuit when the TRIAC is on (510), wherein the variable impedance is adjusted (516) so power used by the glass heater circuit is below a first predetermined value (512). The adjusting of the variable impedance is ended when the power used by the glass heater circuit is below the first predetermined value (514). In some embodiments, the variable impedance is a potentiometer. In some embodiments, the variable impedance is a toggle switch. In some embodiments, the low pass filter is a second-order low pass filter. In some embodiments, the process further comprises directing, via a heatsink, heat into a door rail of the storage device. In some embodiments, the process further comprises directing, via a heatsink, heat into a frame of the storage device.

The construction and arrangement of the elements of the controller and storage device as shown in the various exemplary embodiments are illustrative only. Although only a few implementations of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited.

Numerous specific details are described to provide a thorough understanding of the disclosure. However, in certain instances, well-known or conventional details are not described in order to avoid obscuring the description. References to "some embodiments," "one embodiment," "an exemplary embodiment," and/or "various embodiments" in the present disclosure can be, but not necessarily are, references to the same embodiment and such references mean at least one of the embodiments.

Alternative language and synonyms may be used for anyone or more of the terms discussed herein. No special significance should be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and is not intended to further limit the scope and meaning of the disclosure or of any exemplified term. Likewise, the disclosure is not limited to various embodiments given in this specification.

The elements and assemblies may be constructed from any of a wide variety of materials that provide sufficient strength or durability, in any of a wide variety of colors, textures, and combinations. Further, elements shown as integrally formed may be constructed of multiple parts or elements.

As used herein, the word "exemplary" is used to mean serving as an example, instance or illustration. Any implementation or design described herein as "exemplary" is not necessarily to be construed as preferred or advantageous over other implementations or designs. Rather, use of the word exemplary is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary implementations without departing from the scope of the appended claims.

As used herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

As used herein, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

The background section is intended to provide a background or context to the invention recited in the claims. The description in the background may include concepts that could be pursued, but are not necessarily ones that have been previously conceived or pursued. Therefore, unless otherwise indicated herein, what is described in the background section is not prior art to the description and claims in this application and is not admitted to be prior art by inclusion in the background section.

What is claimed is:

1. A heated glass temperature-controlled storage device, comprising:

a frame;

a door including a door rail and a glass pane, the glass pane including a glass heater circuit, the glass heater circuit including a first end and a second end, the second end coupled to a power return line; and a controller, comprising:

a variable impedance;

a first impedance;

a low pass filter;

a diode for alternating current (DIAC); and a triode for alternating current (TRIAC), wherein the variable impedance is coupled in parallel to the first impedance;

the variable impedance is coupled at a first terminal to an AC power input;

the variable impedance is coupled at a second terminal to an input of the low pass filter;

the DIAC is coupled at a first DIAC terminal to an output of the low pass filter;

the DIAC is coupled at a second DIAC terminal to a gate of the TRIAC;

the TRIAC is coupled at a first TRIAC terminal to the AC power input; and the TRIAC is coupled at a second TRIAC terminal to the first end of the glass heater circuit, wherein the controller is configured to adjust, via the variable impedance and first impedance, voltage from the AC power input to a first voltage;

filter, via the low pass filter, the first voltage;

generate, via the DIAC, a gate current when the DIAC is on, wherein the DIAC is on when the filtered first voltage received from the output of the low pass filter and applied to the first DIAC terminal causes the DIAC to conduct;

generate, via the TRIAC, a glass current when the TRIAC is on, wherein the TRIAC is on when the gate current applied to the gate of the TRIAC causes the TRIAC to conduct, and wherein the glass current is a proportion of current of the AC power input; and provide the glass current to the first end of the glass heater circuit when the TRIAC is on, wherein the variable impedance is adjusted so power corresponding to the glass current provided to the first end of the glass heater circuit is below a first predetermined value.

2. The heated glass temperature-controlled storage device of claim 1, wherein the variable impedance is a potentiometer.

3. The heated glass temperature-controlled storage device of claim 1, wherein the variable impedance is a toggle switch.

4. The heated glass temperature-controlled storage device of claim 1, wherein the low pass filter is a second-order passive low pass filter.

5. The heated glass temperature-controlled storage device of claim 1, further comprising a heatsink coupled to the controller, wherein the heatsink is directed to transfer heat into the door rail of the storage device.

6. The heated glass temperature-controlled storage device of claim 1, further comprising a heatsink coupled to the controller, wherein the heatsink is directed to transfer heat into the frame of the storage device.

7. A system, comprising a storage device comprising a frame and a door, the door comprising a door rail and a glass pane, wherein the glass pane includes a glass heater circuit including a first end and a second end, the second end of the glass heater circuit coupled to a power return line; and a controller comprising a first controller terminal and a second controller terminal, wherein the controller is coupled at the first controller terminal to an AC power input;

the controller is coupled at the second controller terminal to the first end of the glass heater circuit; and wherein the controller is configured to adjust, via a variable impedance coupled in parallel to a first impedance, voltage from the AC power input to a first voltage;

filter, via a low pass filter, the first voltage;

generate, via a DIAC, a gate current when the DIAC is on, wherein the DIAC is on when the filtered first voltage received from the output of the low pass filter and applied to the first DIAC terminal causes the DIAC to conduct;

generate, via a TRIAC, a glass current when the TRIAC is on, wherein the TRIAC is on when the gate current applied to a gate of the TRIAC causes the TRIAC to conduct, and wherein the glass current is a proportion of current of the AC power input; and provide the glass current to the first end of the glass heater circuit when the TRIAC is on, wherein the variable impedance is adjusted so power corresponding to the glass current provided to the first end of the glass heater circuit is below a first predetermined value.

8. The system of claim 7, wherein the variable impedance is a potentiometer.

9. The system of claim 7, wherein the variable impedance is a toggle switch.

10. The system of claim 7, wherein the low pass filter is a second-order passive low pass filter.

11. The system of claim 7, further comprising a heatsink coupled to the controller, wherein the heatsink is directed to transfer heat into the door rail of the storage device.

12. The system of claim 7, further comprising a heatsink coupled to the controller, wherein the heatsink is directed to transfer heat into the frame of the storage device.

13. The system of claim 8, wherein the door of the storage device further comprises a door heater circuit; and the glass heater circuit is coupled to the power return line via the door heater circuit.

14. The system of claim 8, wherein the door of the storage device further comprises a door heater circuit; and the glass heater circuit is coupled, in parallel with the door heater circuit, to the power return line.

15. A method for trimming power of a heated glass temperature-controlled storage device, comprising adjusting, via a variable impedance coupled in parallel to a first impedance and coupled at a first terminal to an AC power input, voltage from the AC power input to a first voltage;

filtering, via a low pass filter coupled to a second terminal of the variable impedance, the first voltage;

generating, via a DIAC coupled to an output of the low pass filter, a gate current when the DIAC is on, wherein the DIAC is on when the filtered first voltage received from an the output of the low pass filter and applied to a first DIAC terminal causes the DIAC to conduct;

generating, via a TRIAC coupled at a first TRIAC terminal to the AC power input, coupled at a second TRIAC terminal to a first end of a glass heater circuit, and including a gate coupled to a second DIAC terminal of the DIAC, a glass current when the TRIAC is on, wherein the TRIAC is on when the gate current applied to the gate of the TRIAC causes the TRIAC to conduct, and wherein the glass current is a proportion of current of the AC power input; and providing the glass current to the first end of a glass heater circuit of the heat glass temperature-controlled storage device including a frame and a door, the door including a rail and a glass pane including the glass heater circuit, the glass heater circuit including a second end coupled to a power return line, the glass current provided when the TRIAC is on, wherein the variable impedance is adjusted so power corresponding to the glass current provided to the first end of the glass heater circuit is below a first predetermined value.

16. The method of claim 15, wherein the variable impedance is a potentiometer.

17. The method of claim 15, wherein the variable impedance is a toggle switch.

18. The method of claim 15, wherein the low pass filter is a second-order low pass filter.

19. The method of claim 15, further comprising directing, via a heatsink, heat into a door rail of the storage device.

20. The method of claim 15, further comprising directing, via a heatsink, heat into a frame of the storage device.

* * * * *